US011849783B2

(12) United States Patent
Puzzo et al.

(10) Patent No.: US 11,849,783 B2
(45) **Date of Patent: *Dec. 26, 2023**

(54) ZIPPERED PANTS

(71) Applicant: Befree, LLC, Swampscot, MA (US)

(72) Inventors: Nicole Puzzo, Swampscott, MA (US); Joanne DiCamillo, Swampscott, MA (US)

(73) Assignee: Befree, LLC, Swampscott, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/155,501

(22) Filed: Jan. 17, 2023

(65) Prior Publication Data

US 2023/0148691 A1 May 18, 2023

Related U.S. Application Data

(63) Continuation of application No. 16/191,160, filed on Nov. 14, 2018, now Pat. No. 11,553,745.
(Continued)

(51) Int. Cl.
*A41D 1/06* (2006.01)
*A41D 13/12* (2006.01)
(Continued)

(52) U.S. Cl.
CPC ..... *A41D 13/1254* (2013.01); *A41D 1/06* (2013.01); *A41D 13/129* (2013.01);
(Continued)

(58) Field of Classification Search
CPC .. A41D 13/1254; A41D 13/129; A41D 13/01; A41D 16/06; A41D 1/06;
(Continued)

(56) References Cited

U.S. PATENT DOCUMENTS 1,986,792 A * 1/1935 Calvo ..... A41D 7/00 D2/731
2,078,874 A 4/1937 Friedman
(Continued)

FOREIGN PATENT DOCUMENTS

CH 212393 A * 2/1940
CH 212393 A 11/1940

OTHER PUBLICATIONS

"Primegreen Essentials Warm-Up Open Hem 3-Stripes Track Pants," Adidas US,<https://www.adidas.com/us/primegreen-essentials-warm-up-open-hem-3-stripes-track-pants/H48429.html>, retrieved Oct. 5, 2021 (5 pages).
(Continued)

*Primary Examiner* — Heather Mangine
(74) *Attorney, Agent, or Firm* — Clark & Elbing LLP

(57) ABSTRACT

Described herein are pants containing a zipper extending through the waistband and the entire outseam of each pant leg. The pants have a flange of fabric disposed on the interior of each zipper to prevent direct contact between the zipper and the skin of a person wearing the pants. The pants also include a fabric tab attached at the waistband next to the zipper to cover an exterior portion of the zipper. The pants provide benefits to wearers who have limited mobility, sensitive skin, or a physical impediment, such as a cast, by easing the challenges of applying the pants to the legs.

1 Claim, 14 Drawing Sheets

Related U.S. Application Data

(60) Provisional application No. 62/586,048, filed on Nov. 14, 2017.

(51) Int. Cl.

| | |
|---|---|
| ***A41D 15/00*** | (2006.01) |
| ***A41D 27/08*** | (2006.01) |
| ***A41D 27/24*** | (2006.01) |
| ***A41D 31/04*** | (2019.01) |
| ***A41D 27/20*** | (2006.01) |

(52) U.S. Cl.
CPC ..... *A41D 15/002* (2013.01); *A41D 27/08* (2013.01); *A41D 27/20* (2013.01); *A41D 27/24* (2013.01); *A41D 31/04* (2019.02); *A41D 2300/20* (2013.01); *A41D 2300/22* (2013.01); *A41D 2300/32* (2013.01); *A41D 2300/322* (2013.01); *A41D 2400/44* (2013.01)

(58) Field of Classification Search
CPC ..... A41D 2300/20; A41F 9/00; A41B 13/04; A41B 13/06
USPC ..... 2/79
See application file for complete search history.

(56) References Cited

U.S. PATENT DOCUMENTS 2,374,299 A 4/1945 O'Hara
2,923,009 A * 2/1960 Cookman ..... A41D 1/06 2/218
3,800,330 A * 4/1974 Bowcut ..... A41D 1/08 2/227
3,914,798 A 10/1975 O'Keefe
D255,168 S 6/1980 Taylor
4,386,438 A * 6/1983 Evin ..... A41D 1/06 2/272
5,033,126 A * 7/1991 Wruck ..... A41D 1/08 2/919
5,131,098 A * 7/1992 Grilliot ..... A41D 1/06 2/81
5,539,932 A * 7/1996 Howard ..... A41D 1/06 2/269
5,560,043 A 10/1996 Armstrong
5,575,010 A * 11/1996 Chung ..... A41D 1/06 2/269
5,706,523 A * 1/1998 Witzel ..... A41D 13/0506 2/467
5,774,892 A * 7/1998 Tisdale ..... A41D 15/00 2/69
5,822,802 A 10/1998 Chou
5,864,888 A 2/1999 Archer
5,918,310 A * 7/1999 Farahany ..... A41D 13/0158 2/455
6,119,270 A * 9/2000 Chou ..... A41D 13/129 2/93
6,148,442 A * 11/2000 Porter ..... A41D 13/01 2/69
6,349,413 B1 * 2/2002 Rose ..... A41D 1/06 2/269
6,408,438 B1 6/2002 McKee
6,854,130 B2 * 2/2005 van der Sleesen .. A41D 27/285 2/69
D528,743 S * 9/2006 MacMillan ..... A41D 15/002 D2/858
D575,028 S 8/2008 Patton
7,516,499 B2 * 4/2009 Gardner, III ..... A41F 9/025 2/221
7,832,022 B1 * 11/2010 Peters ..... A41D 1/084 2/227
D630,415 S * 1/2011 Nunn ..... D2/742
D651,379 S 1/2012 Halpern
8,464,365 B1 * 6/2013 Nunn ..... A41D 1/08 2/227
D693,091 S 11/2013 Peters
D747,074 S 1/2016 Leavitt
D771,909 S 11/2016 Robinson
D777,404 S 1/2017 Lomax
D787,155 S 5/2017 Eisenhuth
D799,157 S 10/2017 Darmour et al.
D841,286 S * 2/2019 Puzzo ..... D2/742
10,231,496 B1 3/2019 Glassner
D866,122 S 11/2019 Karp et al.
D914,332 S 3/2021 Harris et al.
11,553,745 B2 * 1/2023 Puzzo ..... A41D 27/20
2002/0116748 A1 * 8/2002 Lipsett ..... G06Q 30/06 705/22
2003/0051286 A1 * 3/2003 Gregg ..... A41D 27/10 2/93
2005/0155128 A1 * 7/2005 Hayes ..... A41D 13/0005 2/2.15
2007/0204376 A1 * 9/2007 Nunn ..... A41D 1/08 2/69
2008/0092273 A1 * 4/2008 Marshall ..... A41D 1/08 2/227
2008/0141441 A1 * 6/2008 Canter ..... D06P 5/00 347/103
2010/0167626 A1 * 7/2010 Hamlet ..... A41D 31/12 450/95
2010/0235964 A1 * 9/2010 Mickey ..... A41D 13/129 112/475.13
2010/0299804 A1 * 12/2010 Huang ..... A41D 15/00 2/243.1
2011/0010820 A1 * 1/2011 Harding ..... A41D 1/06 2/250
2011/0075399 A1 * 3/2011 Yuan ..... A41D 13/01 362/103
2011/0180079 A1 7/2011 Krawchuk
2011/0191943 A1 * 8/2011 Johnson ..... A41D 1/06 2/244
2012/0096622 A1 * 4/2012 Johnson ..... A41D 15/00 2/93
2012/0110716 A1 5/2012 Christensen et al.
2012/0304361 A1 * 12/2012 Jeffords ..... A41D 27/08 2/243.1
2013/0067640 A1 * 3/2013 Hefter ..... A41D 1/06 2/234
2013/0254969 A1 * 10/2013 Getzen ..... A41D 1/02 2/108
2014/0033395 A1 2/2014 Torgersen
2014/0039422 A1 2/2014 Scott
2014/0366247 A1 * 12/2014 Mize ..... A41D 1/06 2/227
2015/0020288 A1 * 1/2015 Picot ..... A41D 13/129 2/69
2015/0359270 A1 * 12/2015 Stadtmauer ..... A41D 1/08 2/227
2016/0081402 A1 * 3/2016 Nixon, Jr. ..... A41D 1/08 2/243.1
2016/0174622 A1 * 6/2016 Lo ..... A41D 31/00 2/227
2016/0206022 A1 * 7/2016 Kroecher ..... A41D 15/002
2016/0348890 A1 * 12/2016 Polanowski ..... F21V 33/0008
2017/0027246 A1 * 2/2017 Inzer ..... A41D 31/18
2017/0027252 A1 * 2/2017 Inzer ..... A41B 9/001
2017/0042260 A1 * 2/2017 Samuelsen ..... A41D 13/01
2017/0181483 A1 * 6/2017 Eisenhuth ..... A41D 1/08
2017/0290383 A1 * 10/2017 Arnold ..... A41D 27/285
2017/0295856 A1 * 10/2017 Gosse ..... A41D 1/06
2017/0311654 A1 * 11/2017 Miller ..... F21S 4/22
2018/0014586 A1 * 1/2018 Bok ..... A41D 13/129
2018/0020741 A1 1/2018 Kelly
2018/0235290 A1 * 8/2018 Pfanner ..... A44B 19/24
2018/0242661 A1 * 8/2018 Giese ..... A41D 1/08
2018/0255883 A1 * 9/2018 Brandt ..... A41D 13/0015
2019/0000155 A1 * 1/2019 Saunders ..... A41D 3/00
2019/0059815 A1 * 2/2019 Smith ..... A41D 27/08
2019/0116899 A1 * 4/2019 Williams ..... A41D 1/02
2019/0174846 A1 * 6/2019 Puzzo ..... A41D 31/04

(56) References Cited

U.S. PATENT DOCUMENTS

| | | | |
|---|---|---|---|
| 2019/0208831 | A1 | 7/2019 | Joshi |
| 2019/0313702 | A1 | 10/2019 | Karp et al. |
| 2020/0196688 | A1 | 6/2020 | Beernink et al. |
| 2021/0030076 | A1 | 2/2021 | Lee |
| 2021/0059319 | A1 | 3/2021 | Karp et al. |

OTHER PUBLICATIONS

"Magcomsen Men's Lightweight Sweatpants Mesh Joggers Side Stripe Loose Fit Open Bottom Workout, Gym, Yoga," Amazon, <https:// www.amazon.com/dp/B086YV7 4F7/ref=sspa_dk_detail_7?psc=1>, dated Apr. 10, 2020, retrieved on Oct. 5, 2021 (7 pages).
"Screenshotbrand Mens Hip Hop Premium Slim Fit Track Pants—Athletic Jogger Bottom with Side Taping," Amazon, <https://www.amazon.com/dp/B083 B7XS BT /ref=sspa_dk_detai 1_5?pd_rd_i=B07GWN D M PX&pd_rd_w= Rfn2 B&pf_rd_p= 54ed5474-54a8-4c7f-a88a-4%E2%80%A6&th=1>, dated Dec. 7, 2017, retrieved Oct. 5, 2021 (11 pages).

* cited by examiner

ZIPPERED PANTS

BACKGROUND OF THE INVENTION

Putting on pants can pose a challenge for patients recovering from surgery or patients who are paralyzed or bedridden. Such patients may be wearing a cast, splint, or post-surgical dressing over which traditional pants do not fit, or they may be unable to dress themselves and require assistance from a caretaker or medical professional. Furthermore, these patients may have highly sensitive skin, and, thus, require pants that do not cause irritation. There exists a need for pants that are suitable for patients with limited mobility and sensitive skin.

SUMMARY OF THE INVENTION

The present invention provides pants containing a zipper extending through the waistband and the entire outseam of each pant leg and a flange of fabric disposed on the interior of each zipper. The pants provide comfort and ease of use for wearers with limited mobility, sensitive skin, or a physical impediment, such as a cast, compared to traditional pants.

In one aspect, the invention features an article of clothing for a human configured as pants and including a waistband and two pant legs connected to the waistband, in which each leg of the pants comprises a zipper extending from the top of the waistband and along an outseam of the leg, in which each leg further includes: (a) a flange of fabric disposed along the outseam on an interior side of the zipper, in which the fabric has a width across the outseam that is greater than a width of the zipper when the zipper is engaged; and (b) a fabric tab attached at the waistband next to the zipper, in which the tab is positioned to cover an exterior side of the zipper, and in which the tab can be folded over at a point of attachment at the waistband to expose the zipper.

In some embodiments, the pants are made from a moisture wicking polyester.

In some embodiments, the waistband is an elastic waistband.

In some embodiments, the width of the flange is 0.5 centimeters to 5.0 centimeters.

In some embodiments, the flange is the same length as the length of the outseam.

In some embodiments, the flange extends from the top of the waistband to the bottom of the leg (e.g., to the bottom of a cuff).

In some embodiments, the flange is made of the same material as the pants. In some embodiments, the flange is made of a different material than the pants.

In some embodiments, the thickness of the flange is greater than the thickness of the pants.

In some embodiments, the flange is configured to form a barrier between the zipper and the leg of the human when wearing the pants, in which the zipper does not directly contact the skin of the human.

In some embodiments, the tab is folded over to expose the zipper in order to engage or disengage the zipper closure mechanism.

In some embodiments, the tab is made of the same material as the pants. In some embodiments, the tab is made of a different material than the pants.

In some embodiments, the thickness of the tab is greater than the thickness of the pants.

In some embodiments, the tab is attached anterior to the zipper and folds toward the back of the waistband to cover the zipper.

In some embodiments, the position of the tab over the zipper is maintained by the resiliency of the tab.

In some embodiments, the zipper closure mechanism is configured to be engaged at the waistband and the zipper is configured for closure by pulling the zipper down from the waistband toward the cuff along the outseam. In some embodiments, the zipper closure mechanism is configured to be engaged at the cuff and the zipper is configured for closure by pulling the zipper up from the cuff toward the waistband along the outseam.

In some embodiments, the pants further include a logo.

In some embodiments, the flange is visible from the exterior of the pants when the zipper is disengaged.

In some embodiments, the leg and waistband can be opened completely along the outseam when the zipper is disengaged.

The pants can be made of a soft, comfortable fabric (e.g., moisture wicking polyester, cotton, rayon, or denim). The pants may lack a cuff. The pants may include one or more pockets (e.g., one or more front pockets, back pockets, or combinations thereof). The one or more pockets may be positioned on the pant legs (e.g., in the interior or exterior of the pants). The pockets may have a slanted opening that is positioned 1.0 to 5.0 centimeters from the outseam containing the zipper (e.g., 1.0, 1.5, 2.0, 2.5, 3.0, 3.5, 4.0, 4.5, or 5.0 centimeters from the outseam containing the zipper). The pants may be configured such that the pockets are not visible when the pants are viewed from the front. For example, the opening of the pocket may be a vertical opening that runs along the outseam containing the zipper. In some embodiments, the pants are convertible (e.g., the pants contain a zipper that allows the upper and lower leg portions to be separated, such as is described in U.S. Pat. No. 8,832,867; incorporated herein by reference).

The pants may contain a reflective material (e.g., a reflective material that is printed on or attached to the exterior of the pants). The reflective material allows for better visibility at night. The reflective material can be positioned along the outseam of the pants on one or both sides of the zipper and may extend from the top of the waistband to the bottom of the leg (e.g., the bottom of the cuff) or any distance along that length.

DETAILED DESCRIPTION

Figure 1:
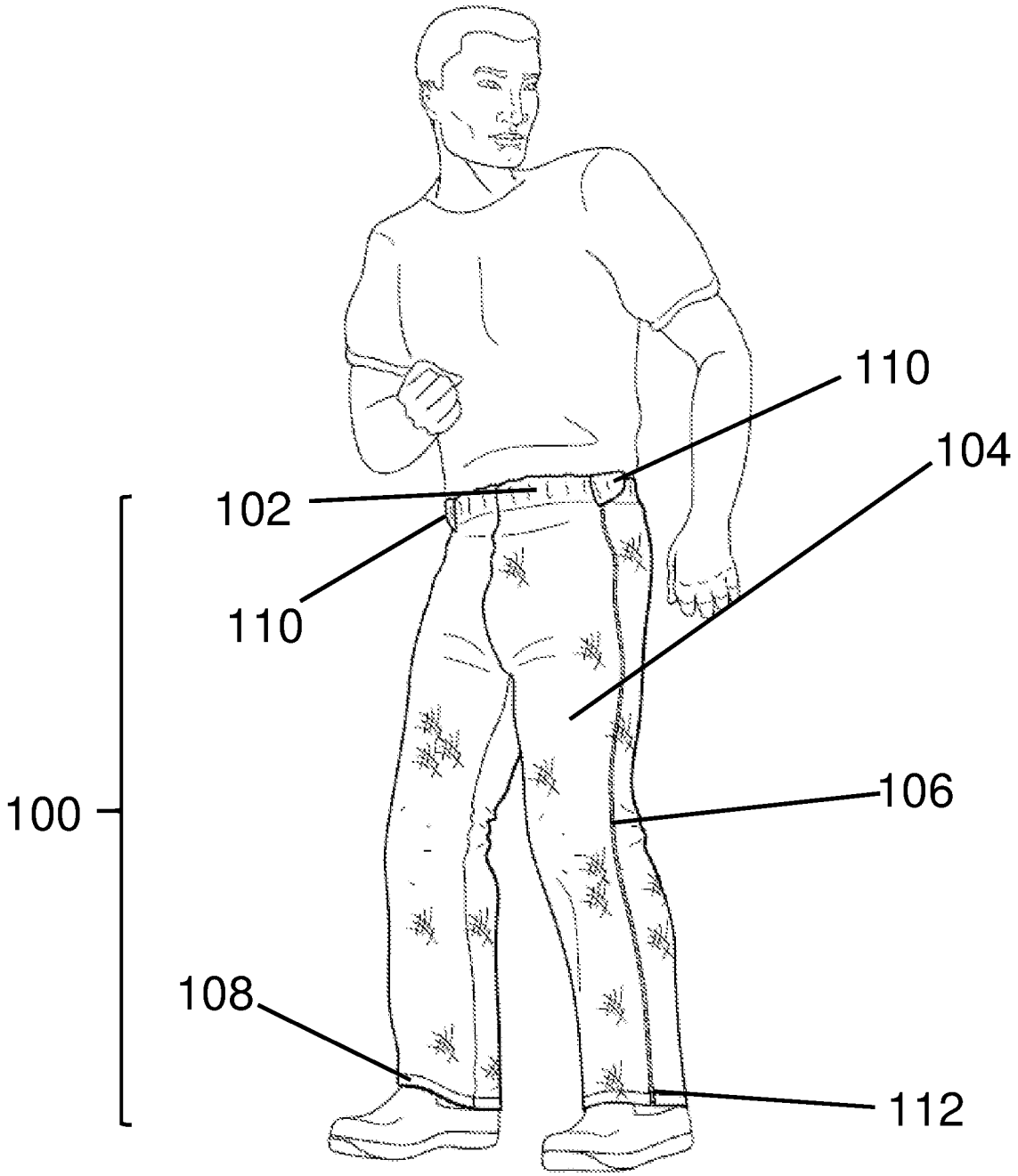
FIG. 1 is a front perspective view of a person wearing pants (100) that include waistband (102), pant leg (104), outseam (106), and cuff (108). Tab (110) is attached at waistband (102) anterior to zipper (112) and is oriented toward the back of waistband (102) to cover the portion of zipper (112) that extends through waistband (102). Zipper (112) extends from the top of waistband (102) along outseam (106) to cuff (108).

Described herein is an article of clothing configured as pants that include a zipper that extends through the waistband and the outseam of each pant leg. When unzipped, the pants open completely on each side. The pants further include a waistband and are designed to fit loosely. The waistband may include an elastic material or may be configured to tighten using a drawstring.

The waistband may be dimensioned to be 0.5 to 5.0 centimeters wide (e.g., the distance from the top to the bottom of the waistband may be 0.5, 0.5, 1.0, 1.5, 2.0, 2.5, 3.0, 3.5, 4.0, 4.5, or 5.0 centimeters).

The pants may also include a cuff. The cuff may be dimensioned to be 0.5 to 5.0 centimeters wide (e.g., the distance from the top to the bottom of the cuff may be 0.5, 0.5, 1.0, 1.5, 2.0, 2.5, 3.0, 3.5, 4.0, 4.5, or 5.0 centimeters). In some embodiments, the pants do not include a cuff. The pants can be made of a soft, comfortable fabric (e.g., moisture wicking polyester, cotton, rayon, or denim). The fabric used to make the pants can be any color. The pants can be sized for children or adults, and come in sizes including extra small (XS), small (S), medium (M), large (L), extra large (XL), and extra extra large (XXL). The pants are configured to be worn by a male, female, or unisex human.

The ability to completely open each pant leg allows the pants to be put on without being pulled up through the legs. The pants can be easily taken on and off while lying in bed or standing up. The pants can be worn by a person with a cast or medical device on one or both legs. The pants can remain unzipped in the region of the cast or medical device. The pant leg may be sized to enclose a cast around the leg, foot, or both of a wearer.

The zipper tracks can be engaged at the waistband (e.g., the box and pin are at the top of the waistband) and the zipper can be fastened by pulling the slider down toward the cuff. The zipper can extend through the cuff or only to the top of the cuff (e.g., the cuff can be held closed with a separate fastener, such as hook-and-loop fasteners (e.g., VELCRO™), a snap, or a button). The zipper tracks can also be engaged at the cuff (e.g., the box and pin are at the bottom or top of the cuff) and the zipper can be fastened by pulling the slider up toward the waistband. The zipper may also contain double sliders (e.g., sliders arranged in head-to-head relation or bottom-to-head relation). In some embodiments, rings, cord (e.g., nylon cord), or other materials are added to zipper pulls to facilitate the ability of a wearer, e.g., with motor dysfunction or limited mobility, to dress themselves.

The pants further include a flange of fabric disposed on an interior side of each zipper. The flange of fabric runs along the entire length of each zipper (e.g., from the top of the waistband to the bottom of the leg, e.g., to the top or bottom of the cuff) and is at least as wide, or wider than, the zipper when the zipper is engaged. The flange may be dimensioned to be 0.5 to 5.0 centimeters wide (e.g., 0.5, 0.5, 1.0, 1.5, 2.0, 2.5, 3.0, 3.5, 4.0, 4.5, or 5.0 centimeters wide). The flange can be made of the same material as the pants or of a different material than the pants. The flange forms a barrier between the zipper and the skin of the wearer to prevent the zipper from coming into direct contact with the skin and to reduce irritation that could occur in a wearer with sensitive skin. One or more fasteners may be positioned on the side of the flange that faces the zipper to hold the flange in place to cover the zipper (e.g., one or more hook-and-loop fasteners (e.g., VELCRO™), snaps, or buttons can be used to connect the side of the flange that faces the zipper to the interior of the pants). The flange may have the same thickness as the pants (e.g., the flange is made of a material that is equally as thick as the material of the pants) or a different thickness. The flange may be thicker than the pant material (e.g., the flange is made of a material that is thicker than the material of the pants, or the flange contains multiple layers of fabric to increase its thickness) or thinner than the pant material. The flange may be dimensioned to be 0.5 to 10 millimeters thick (e.g., 0.5, 0.5, 1.0, 1.5, 2.0, 2.5, 3.0, 3.5, 4.0, 4.5, 5.0, 6.0, 7.0, 8.0, 9.0, or 10.0 millimeters thick). The back of the flange (e.g., the interior side of the flange that would contact the skin of a person wearing the pants) may be coated with a soft material, such as fleece or cotton. The flange is not visible when the zipper is engaged and the leg of the pants is completely closed. When the leg of the pants is partially or completely unzipped (e.g., when the zipper is disengaged), the flange can be observed from the outside of the pants.

The pants may further include a flange of fabric disposed on an exterior side of each zipper. The exterior flange may run along the entire length of each zipper (e.g., from the top of the waistband to the bottom of the leg, e.g., to the top or bottom of the cuff) or most of the length of each zipper (e.g., from the bottom of the waistband or below the tab at the waistband to the bottom of the leg, e.g., to the top or bottom of the cuff) and is at least as wide, or wider than, the zipper when the zipper is engaged. The exterior flange may be dimensioned to be 0.5 to 5.0 centimeters wide (e.g., 0.5, 0.5, 1.0, 1.5, 2.0, 2.5, 3.0, 3.5, 4.0, 4.5, or 5.0 centimeters wide). The exterior flange can be made of the same material as the pants or of a different material than the pants. One or more fasteners may be positioned on the underside of the exterior flange (e.g., the side of the flange that faces the zipper) to hold the flange down to cover the zipper (e.g., one or more hook-and-loop fasteners (e.g., VELCRO™), snaps, or buttons can be used to connect the underside of the exterior flange to the pants). The exterior flange may have the same thickness as the pants (e.g., the exterior flange is made of a material that is equally as thick as the material of the pants) or a different thickness. The exterior flange may be thicker than the pant material (e.g., the exterior flange is made of a material that is thicker than the material of the pants, or the exterior flange contains multiple layers of fabric to increase its thickness) or thinner than the pant material. The exterior flange may be dimensioned to be 0.5 to 10 millimeters thick (e.g., 0.5, 0.5, 1.0, 1.5, 2.0, 2.5, 3.0, 3.5, 4.0, 4.5, 5.0, 6.0, 7.0, 8.0, 9.0, or 10.0 millimeters thick). The exterior flange can be observed from the outside of the pants when the zipper is engaged or disengaged. When the zipper is engaged, the exterior flange hides the zipper from view and forms a barrier that covers the exterior of the zipper.

The pants further include a fabric tab attached (e.g., sewn) to the waistband next to each zipper. The tab is positioned to cover an exterior side of the zipper at the waistband when the pants are being worn, and the tab can be folded over at the point of attachment at the waistband to expose the zipper (e.g., to engage or disengage the zipper when the pants are being taken on or off). The tab is attached at one end to the exterior of the waistband (e.g., the anterior end of the tab is attached at the exterior of the waistband if the tab is attached anterior to the zipper, or the posterior end of the tab is attached at the exterior of the waistband if the tab is attached posterior to the zipper) and the other end of the tab is not attached at the waistband so that it can be folded back. The end of the tab that is attached at the exterior of the waistband may also be attached at a top part of the pant leg and/or to the top of the waistband. In some embodiments, the top of the tab folds completely or partially over the top of the waistband so that the zipper is fully enclosed. In some embodiments, the tab is longer on the end that attaches at the waistband than on the end that is unattached. The tab can have a length that is longer than the width of the waistband. The tab can be configured in any shape that is sufficient to cover the zipper at the waistline. For example, the tab can be shaped as a triangle, a rectangle, or a square. In some embodiments, the tab is rounded on one or more sides. The tab may be made of the same material as the pants or of a different material. The tab can be the same thickness as the pants (e.g., the tab is made of a material that is equally as thick as the material of the pants) or the tab may be thicker than the pant material (e.g., the tab is made of a material that is thicker than the material of the pants, or the tab contains multiple layers of fabric to increase its thickness) or thinner than the pant material. The tab may be dimensioned to be 0.5 to 10 millimeters thick (e.g., 0.5, 0.5, 1.0, 1.5, 2.0, 2.5, 3.0, 3.5, 4.0, 4.5, 5.0, 6.0, 7.0, 8.0, 9.0, or 10.0 millimeters thick). The tab can be held in place over the zipper by the resiliency of the fabric of the tab. In some embodiments, the tab is attached anterior to the zipper and is oriented toward the back of the waistband to cover the zipper. The side of the tab that is not attached at the waistband may be held in place when oriented to cover the zipper by a fastener (e.g., a hook-and-loop fastener (e.g., VELCRO™), a snap, or a button).

The pants may further include a similar fabric tab attached (e.g., sewn) at the cuff next to each zipper that is positioned to cover an exterior side of the zipper at the cuff when the pants are being worn, and that can be folded over at the point of attachment at the cuff to expose the zipper (e.g., to engage or disengage the zipper when the pants are being taken on or off). The tab is attached at one end to the exterior of the cuff (e.g., the anterior end of the tab is attached at the exterior of the cuff if the tab is attached anterior to the zipper, or the posterior end of the tab is attached at the exterior of the cuff if the tab is attached posterior to the zipper) and the other end of the tab is not attached at the cuff so that it can be folded back. The end of the tab that is attached at the exterior of the cuff may also be attached at a bottom part of the pant leg and/or to the bottom of the cuff. In some embodiments, the tab folds completely or partially over the bottom of the cuff so that the zipper is fully enclosed. In some embodiments, the tab is longer on the end that attaches at the cuff than on the end that is unattached. The tab can have a length that is longer than the width of the cuff. The tab can be configured in any shape that is sufficient to cover the zipper at the cuff. For example, the tab can be shaped as a triangle, a rectangle, or a square. In some embodiments, the tab is rounded on one or more sides. The tab may be made of the same material as the pants or of a different material. The tab can be the same thickness as the pants (e.g., the tab is made of a material that is equally as thick as the material of the pants) or the tab may be thicker than the pant material (e.g., the tab is made of a material that is thicker than the material of the pants, or the tab contains multiple layers of fabric to increase its thickness) or thinner than the pant material. The tab may be dimensioned to be 0.5 to 10 millimeters thick (e.g., 0.5, 0.5, 1.0, 1.5, 2.0, 2.5, 3.0, 3.5, 4.0, 4.5, 5.0, 6.0, 7.0, 8.0, 9.0, or 10.0 millimeters thick). The tab can be held in place over the zipper by the resiliency of the fabric of the tab. In some embodiments, the tab is attached anterior to the zipper and is oriented toward the back of the cuff to cover the zipper. The side of the tab that is not attached at the cuff may be held in place when oriented to cover the zipper by a fastener (e.g., a hook-and-loop fastener (e.g., VELCRO™), a snap, or a button). In some embodiments, the pants include both a fabric tab attached at the waistband and a fabric tab attached at the cuff. In some embodiments, the pants include either a fabric tab attached at the waistband or a fabric tab attached at the cuff.

In some embodiments, the pants may also include an optional logo. In some embodiments, the logo is on a tab of fabric that is attached to the pants, e.g., on the bottom of one or both of the pant legs (e.g., on the right or left pant leg). For example, the logo can be attached to the cuff of a pant leg. In some embodiments, the logo is screen printed onto one of the pant legs (e.g., screen printed onto the cuff of a pant leg). In some embodiments, the logo is embroidered onto one of the pant legs (e.g., embroidered onto the cuff of a pant leg). In some embodiments, the logo is on the flange (e.g., on the side of flange that is visible when pants are unzipped). In some embodiments, the logo is screen printed or embroidered onto the flange.

The pants may also include one or more pockets (e.g., one or more front pockets, back pockets, or combinations thereof). In some embodiments, the pants include one or more pockets on the pant legs. In some embodiments, the pockets are on the exterior of the pants. In some embodiments, the pockets are on the interior of the pants. In some embodiments, the pockets have a slanted opening that is positioned 1.0 to 5.0 centimeters from the outseam containing the zipper (e.g., 1.0, 1.5, 2.0, 2.5, 3.0, 3.5, 4.0, 4.5, or 5.0 centimeters from the outseam containing the zipper). In some embodiments, the pockets are not visible when the pants are viewed from the front. For example, the opening of the pocket may be a vertical opening that runs along the outseam containing the zipper. In some embodiments, the pockets are lined with a soft material, such as fleece or cotton. In some embodiments, the pants are convertible (e.g., the pants contain a zipper that allows the upper and lower leg portions to be separated, such as the mechanism in U.S. Pat. No. 8,832,867; incorporated herein by reference). In some embodiments, the pants contain reflective material (e.g., a reflective material is printed on or attached to the exterior of the pants) to allow for better visibility at night. The reflective material (e.g., reflective piping) can be positioned along the outseam of the pants on one or both sides of the zipper, and may extend from the top of the waistband to the bottom of the leg (e.g., to the bottom of the cuff) or any distance along that length.

The pants described herein are suitable for a wearer recovering from surgery, who may have limited mobility or may be wearing a cast, brace, bar, or other medical equipment on one or both of their lower extremities that would make it difficult or impossible to wear typical pants that need to be pulled up through the legs. The pants described herein are also suitable for a wearer that may be bedridden or in need of help with dressing while lying down.

The pants are also suitable for a wearer with sensitive skin, given that the flange and tab included in the pants block the zipper from coming into contact with the skin or causing abrasion or irritation.

The pants described herein are also suitable for children with sensory issues (e.g., children with sensory processing issues, sensory processing disorder, attention deficit hyperactivity disorder (ADHD), or autism spectrum disorder (ASD)), who may be bothered by the feel of a zipper on their legs.

Uses

Figure 2:
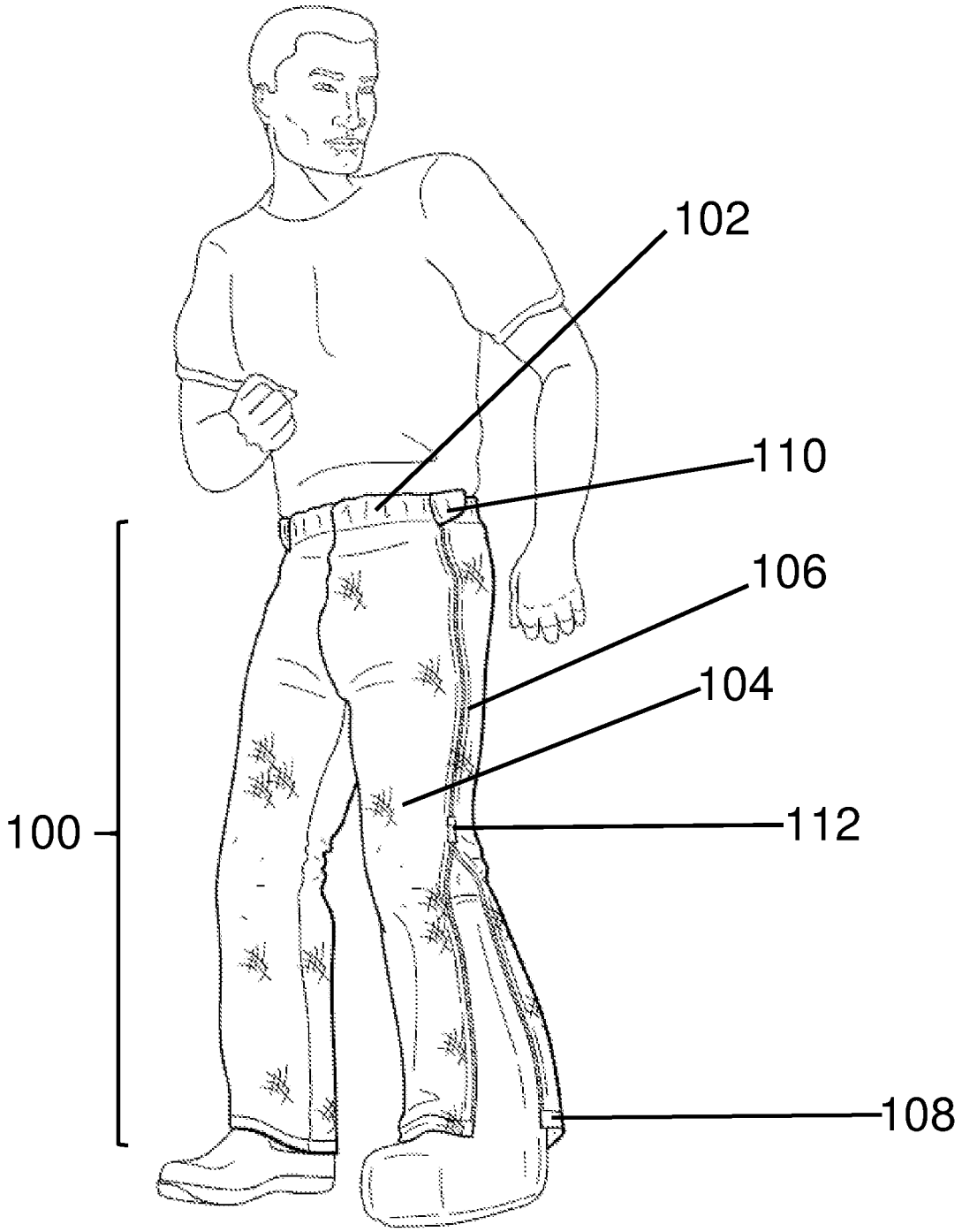
FIG. 2 is a front perspective view of a person wearing pants (100) that include waistband (102), pant leg (104), outseam (106), and cuff (108). Tab (110) is attached at waistband (102) anterior to zipper (112) and is oriented toward the back of waistband (102) to cover the portion of zipper (112) that extends through waistband (102). Zipper (112) extends from the top of waistband (102) along outseam (106) to cuff (108), and is engaged from the top of waistband (102) to approximately half-way down outseam (106). Zipper (112) on bottom half of outseam (106) is disengaged to accommodate a cast positioned about the lower leg.
Figure 3:
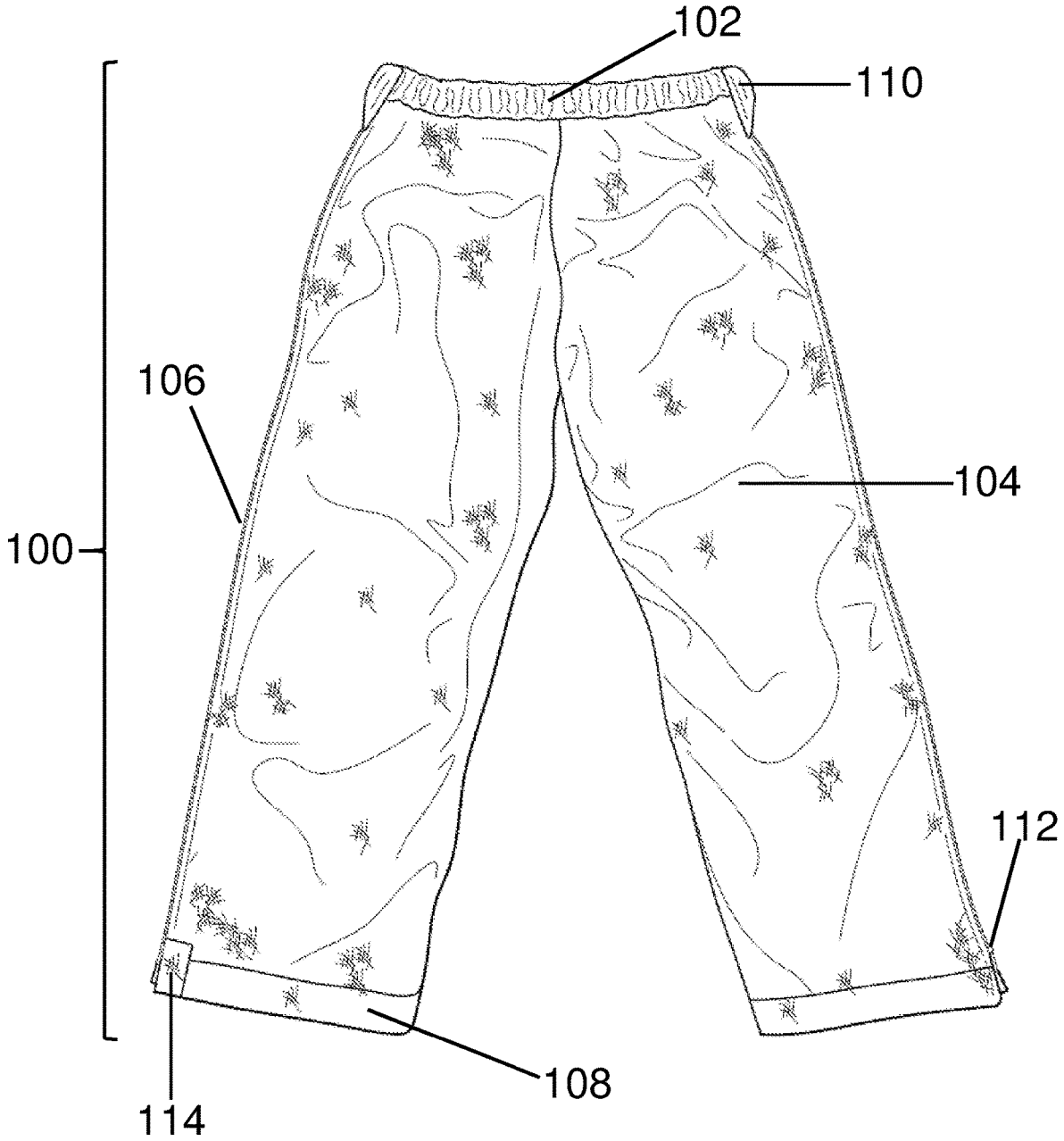
FIG. 3 is a front elevation view of pants (100) that include waistband (102), pant leg (104), outseam (106), and optional cuff (108). Tab (110) is attached at waistband (102) anterior to zipper (112) and is oriented toward the back of waistband (102) to cover the portion of zipper (112) that extends through waistband (102). Zipper (112) extends from the top of waistband (102) along outseam (106) to cuff (108). Optional logo (114) is displayed on cuff (108) of pant leg (104).
Figure 4:
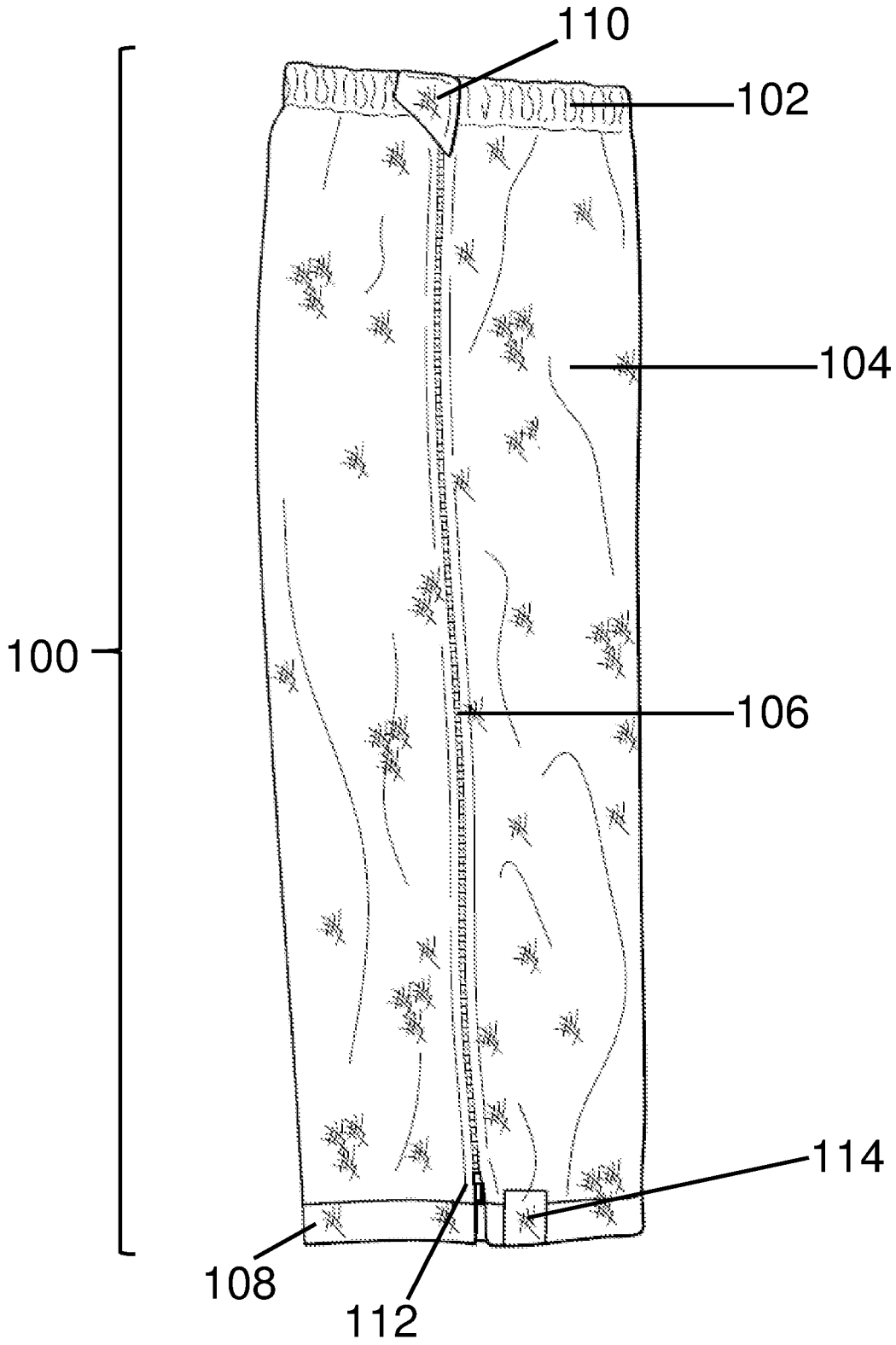
FIG. 4 is a right side elevation view of pants (100) that include waistband (102), pant leg (104), outseam (106), and cuff (108). Tab (110) is attached at waistband (102) anterior to zipper (112) and is oriented toward the back of waistband (102) to cover the portion of zipper (112) that extends through waistband (102). Zipper (112) extends from the top of waistband (102) along outseam (106) to cuff (108). The left side elevation view is a mirror image of the right side elevation view. Optional logo (114) is displayed on cuff (108) of pant leg (104).
Figure 5:
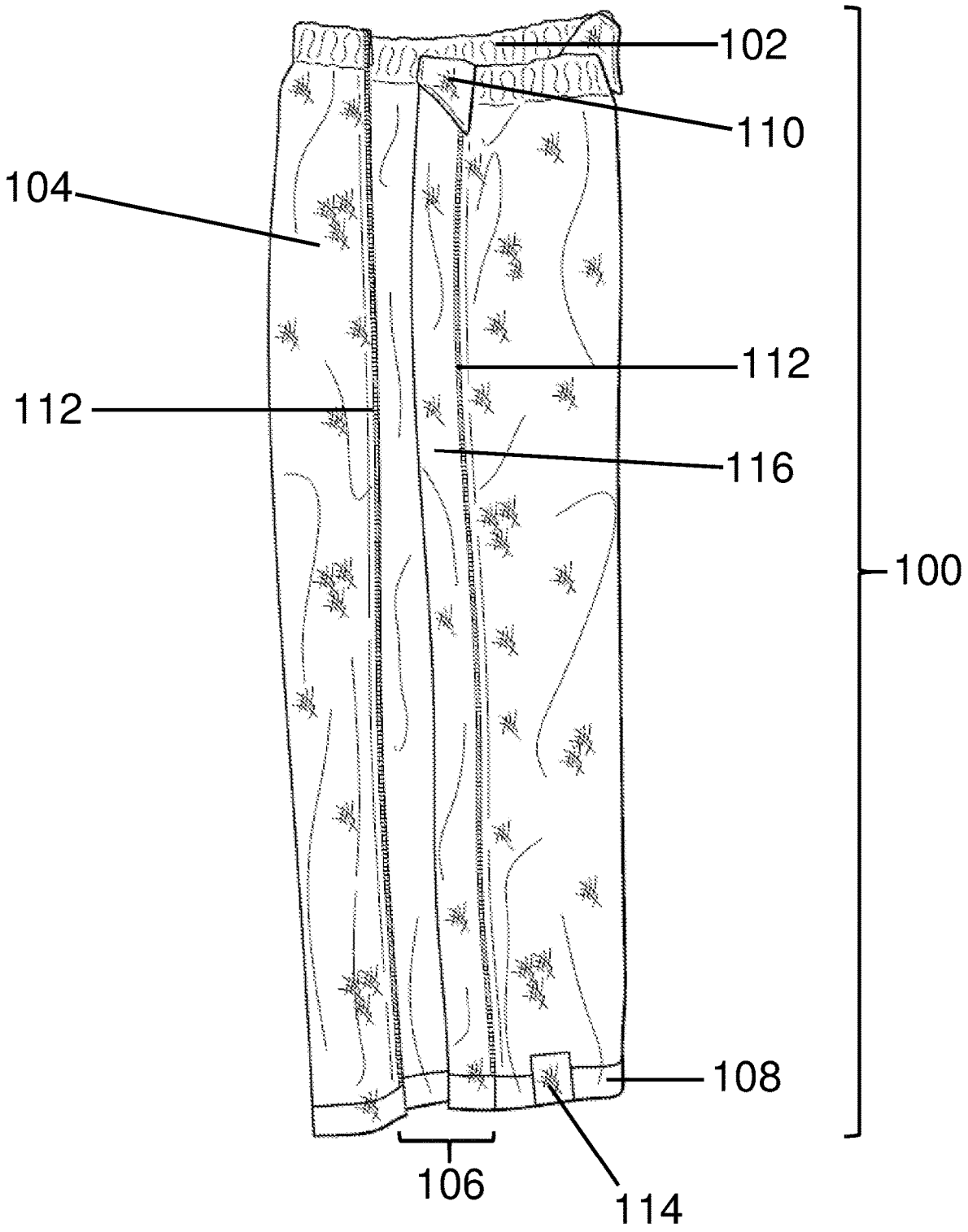
FIG. 5 is a right side elevation view of pants (100) with zipper (112) completely disengaged. Pants (100) include waistband (102), pant leg (104), outseam (106), cuff (108), and tab (110). When zipper (112) is disengaged, flange (116) is visible behind one of the zipper tracks. Both zipper (112) and flange (116) extend from the top of waistband (102) to cuff (108). Flange (116), which contains a first edge that is attached to the interior of the leg of the pants (100) and a second edge that is not attached, is disposed on the interior of zipper (112) to prevent zipper (112) from coming into direct contact with the leg of a person wearing pants (100). Tab (110) is attached at waistband (102) anterior to zipper (112) and is oriented toward the back of waistband (102) to cover the portion of zipper (112) that extends through waistband (102). As shown, pant leg (104) can be opened completely along outseam (106) when zipper (112) is completely disengaged. When the two zipper tracks are engaged, the back of zipper (112) will be fully covered by flange (116) along an interior of outseam (106). The left side elevation view is a mirror image of the right side elevation view. Optional logo (114) is displayed on cuff (108) of pant leg (104).
Figure 6:
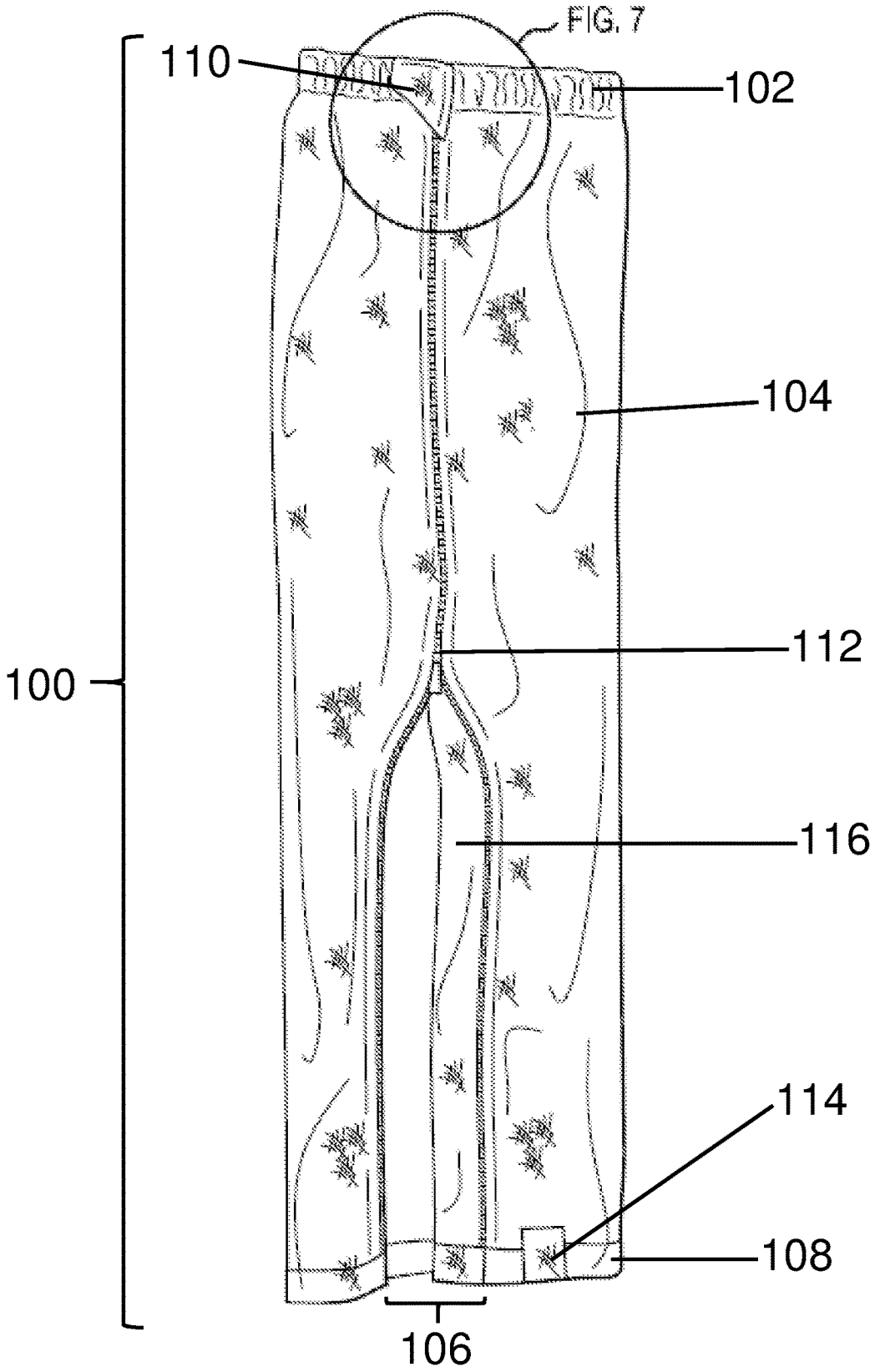
FIG. 6 is a right side elevation view of pants (100) with zipper (112) partially engaged. Pants (100) include waistband (102), pant leg (104), outseam (106), cuff (108), and tab (110). As shown, zipper (112) is engaged at waistband (102) and pant leg (104) is closed approximately through half of the length of outseam (106). In the bottom half of pant leg (104) in which zipper (112) is disengaged, flange (116), which contains a first edge that is attached to the interior of the leg of the pants (100) and a second edge that is not attached, is visible behind one of the zipper tracks. The ability to wear pants (100) with outseam (106) partially unzipped allows pants (100) to be worn by a person with a cast, splint, or other device disposed about the leg that is too large to fit in pant leg (104) when zipper (112) is fully engaged along outseam (106). The circled region highlights tab (110), which is attached at waistband (102) anterior to zipper (112) and oriented toward the back of waistband (102) to cover the portion of zipper (112) that extends through waistband (102). Optional logo (114) is displayed on cuff (108) of pant leg (104).
Figure 7:
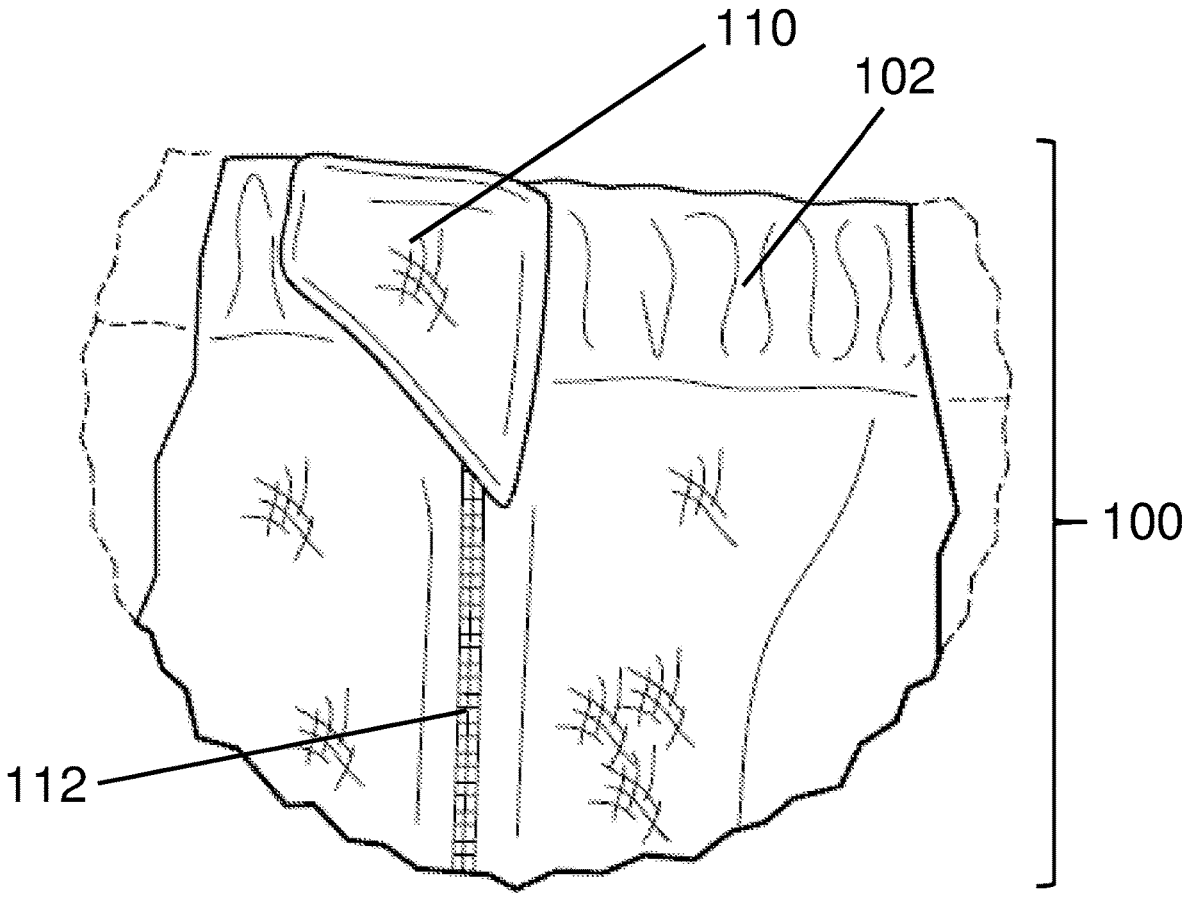
FIG. 7 is an enlarged right side elevation view of tab (110) shown in FIG. 6. One end of tab (110) is attached at waistband (102) anterior to zipper (112). Tab (110) is oriented toward the back of waistband (102), covering the portion of zipper (112) that extends through waistband (102). The other end of tab (110) is not attached at waistband (102), which allows tab (110) to fold back to expose zipper (112).
Figure 8:
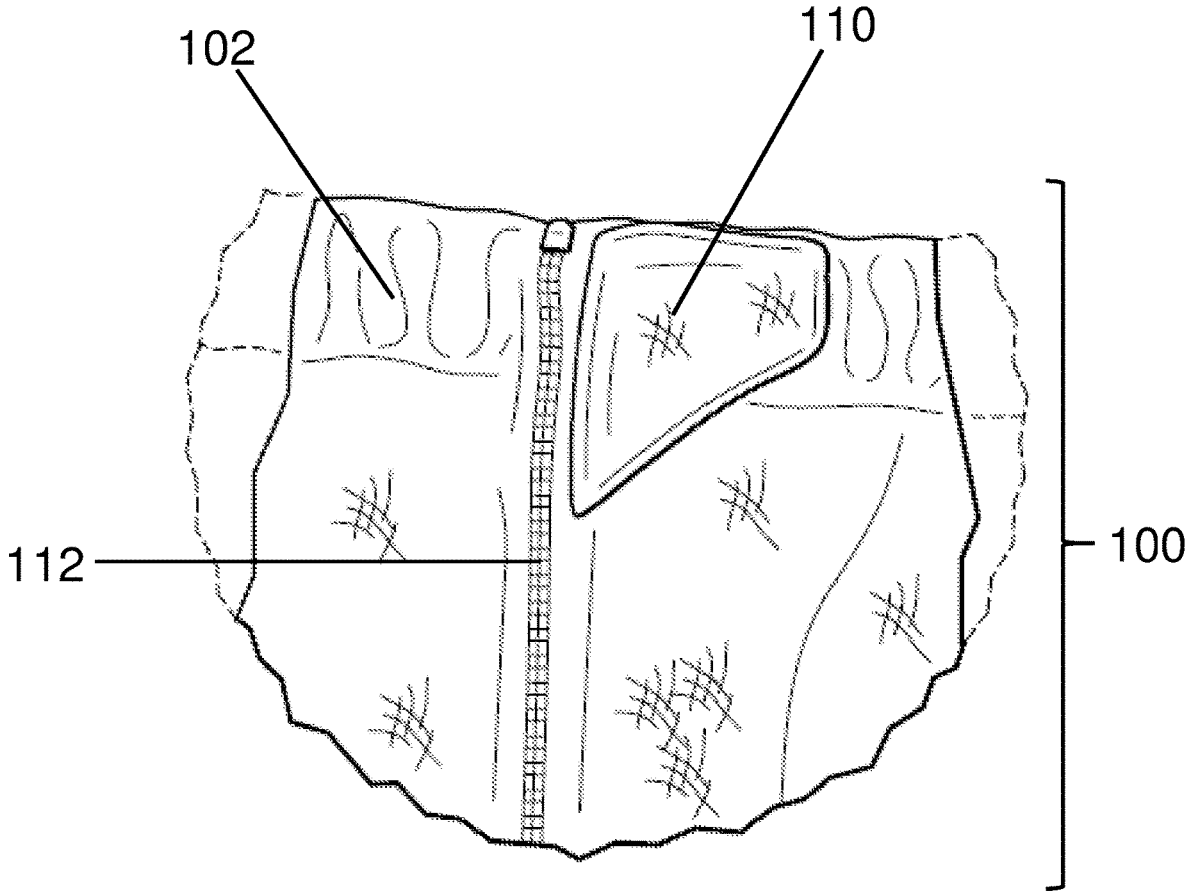
FIG. 8 is an enlarged right side elevation view of tab (110) when it is folded back over waistband (102) to expose zipper (112). Tab (110) can be folded back to engage or disengage zipper (112). As shown, the box and pin of zipper (112) are at the top of waistband (102) indicating that zipper (112) is engaged at waistband (102) of pants (100) and that outseam (106) is closed by pulling the slider down toward cuff (108).

Pants (100) are suitable for a wearer recovering from surgery, a wearer with limited to no mobility (e.g., a wearer that may be bedridden or paralyzed), and for children or adults with sensory issues (e.g., with highly sensitive skin or with sensory processing issues, such as children with ASD). With reference to FIGS. 1-8, when zipper (112) is fully disengaged, pant leg (104) and waistband (102) are completely open, flange (116) is visible, and pant leg (104) can be wrapped around the leg of a wearer (e.g., a wearer that is bedridden, paralyzed, recovering from surgery or an injury, or that has a cast, brace, or other large device disposed about the leg that prevents pants (100) from being pulled up while zipper (112) is engaged). Depending on the orientation of zipper (112), pant leg (104) can be closed by engaging zipper (112) at waistband (102) and pulling the zipper slider down outseam (106) toward cuff (108), or, alternatively, by engaging zipper (112) at cuff (108) and pulling the zipper slider up outseam (106) toward waistband (102). If a cast, brace, or other large device on the leg prevents pant leg (104) from being fully closed, zipper (112) can remain disengaged in that region while pants (100) cover the remainder of the lower body.

Flange (116) is positioned on the interior of zipper (112) to prevent direct contact between zipper (112) and the skin of a person wearing pants (100). Flange (116) is wider than zipper (112) when zipper (112) is engaged. Flange (116) may be thicker than the material of pants (100), and may contain padding or a soft fabric on the interior for increased comfort. Tab (110) also prevents contact between the skin of a person wearing pants (100) and the portion of zipper (112) in waistband (102). Tab (110) is folded back along waistband (102) to expose zipper (112) when pants (100) are being put on or taken off and zipper (112) needs to be engaged or disengaged. When pants (100) are being worn, tab (110) is positioned so that it covers the top and exterior of zipper (112) in waistband (102).

Figure 9:
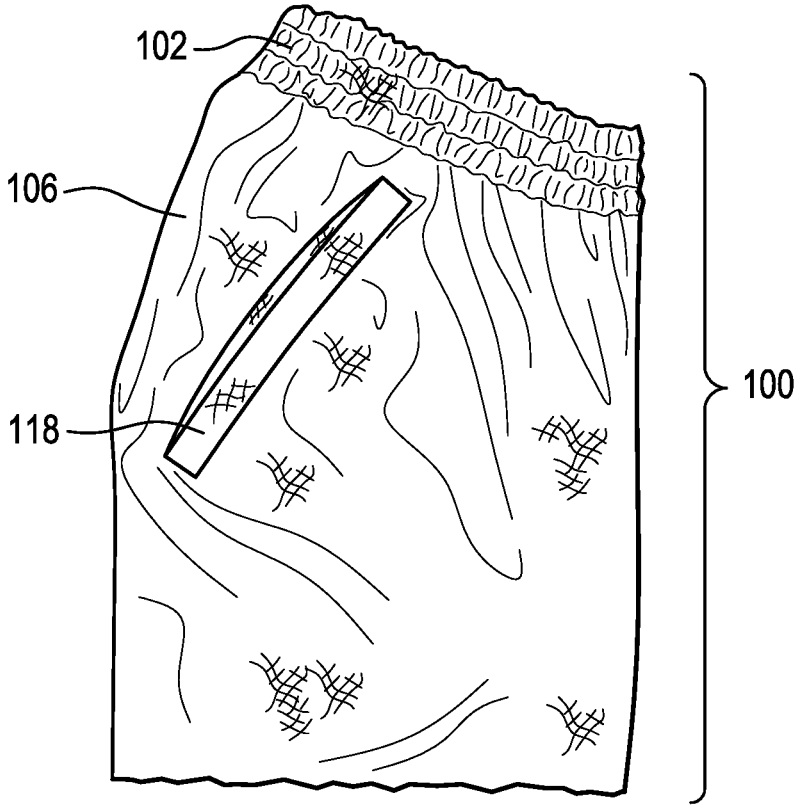
FIG. 9 is a front elevation view of pants (100) that include waistband (102), and outseam (106). Pants (100) include pocket (118) having a slanted opening. One end of pocket (118) is positioned near outseam (106) and the other end of pocket (118) is positioned near waistband (102).
Figure 10:
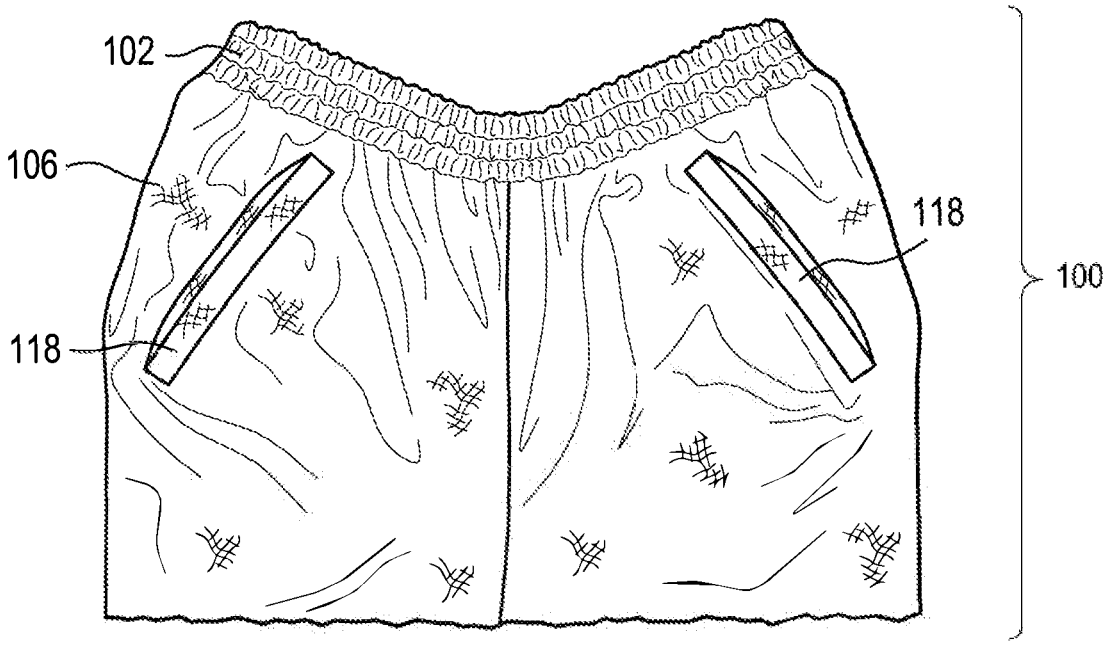
FIG. 10 is a front elevation view of pants (100) that include waistband (102), and outseam (106). Pants (100) include pocket (118) having a slanted opening. Pocket (118) is positioned near outseam (106) and waistband (102) on both the right and left side of pants (100).
Figure 11:
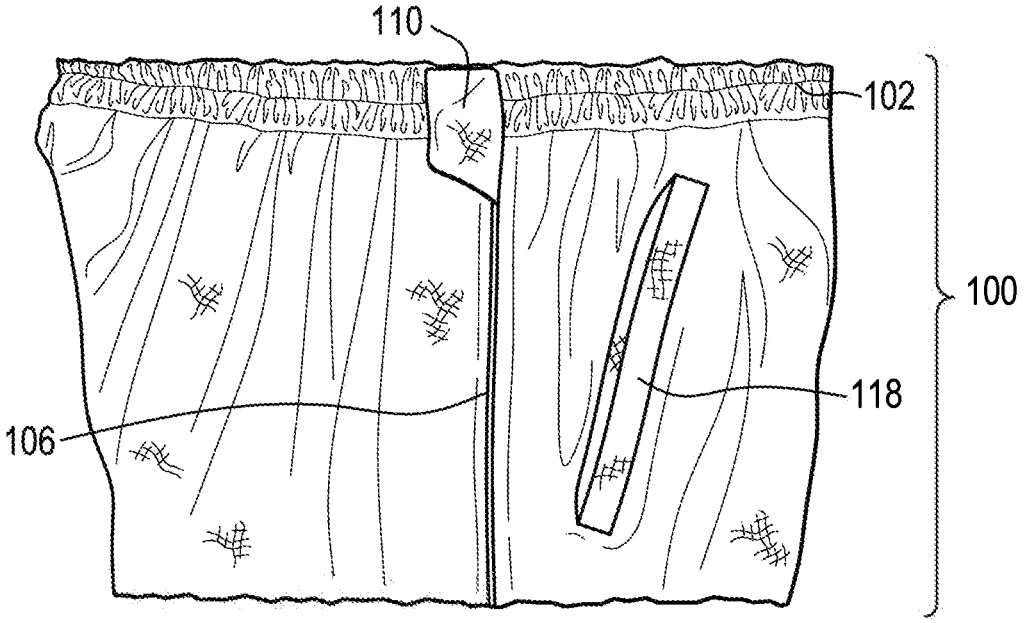
FIG. 11 is a right side elevation view of pants (100) that include waistband (102), outseam (106), and tab (110). One end of tab (110) is attached at waistband (102) anterior to the zipper. Tab (110) is oriented toward the back of waistband (102), covering the portion of the zipper that extends through waistband (102). The other end of tab (110) is not attached at waistband (102), which allows tab (110) to fold in the opposite direction, toward the front of waistband (102), to expose the zipper. Pants (100) further include pocket (118) having a slanted opening. One end of pocket (118) is positioned near outseam (106) and the other end of pocket (118) is positioned near waistband (102).
Figure 12:
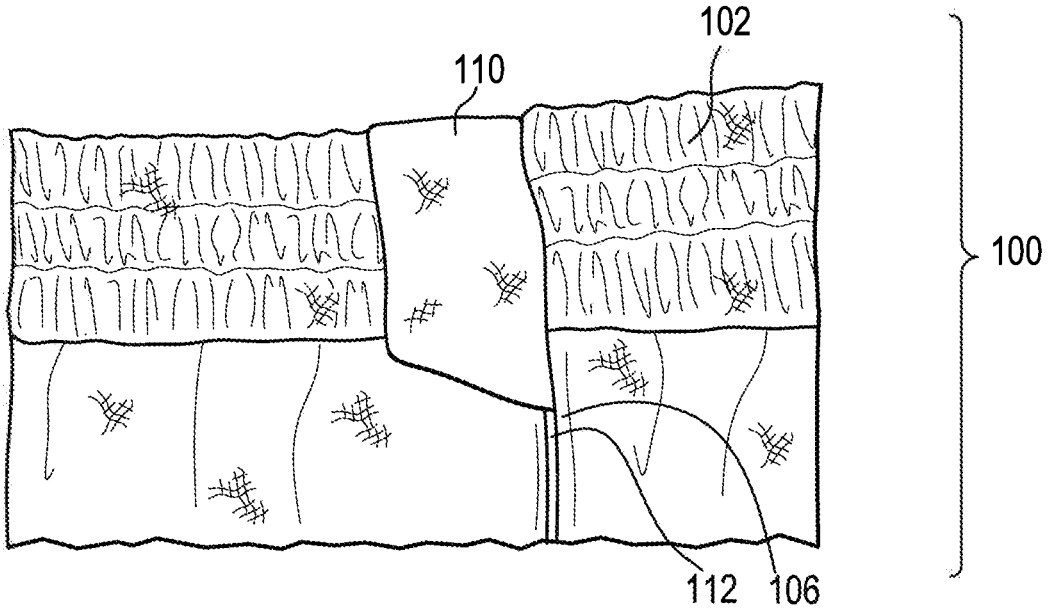
FIG. 12 is an enlarged right side elevation view of pants (100) that include waistband (102), outseam (106), zipper (112), and tab (110). One end of tab (110) is attached at waistband (102) anterior to zipper (112). Tab (110) is oriented toward the back of waistband (102), covering the portion of zipper (112) that extends through waistband (102). The other end of tab (110) is not attached at waistband (102), which allows tab (110) to fold in the opposite direction, toward the front of waistband (102), to expose zipper (112).
Figure 13:
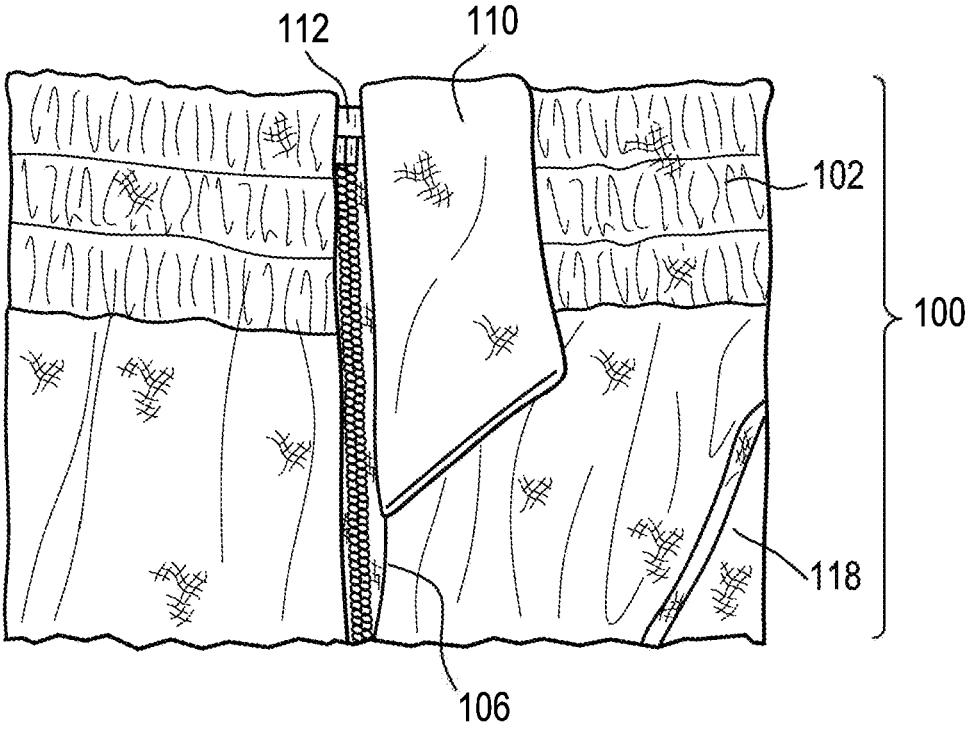
FIG. 13 is an enlarged right side elevation view of pants (100) that include waistband (102), outseam (106), zipper (112), and tab (110). One end of tab (110) is attached at waistband (102) anterior to zipper (112). In this view, tab (110) is folded toward the front of waistband (102) to expose zipper (112). As shown, the box and pin of zipper (112) are at the top of waistband (102) indicating that zipper (112) is engaged at waistband (102) of pants (100) and that outseam (106) is closed by pulling the slider down toward cuff (108). Pants (100) further include pocket (118) having a slanted opening.
Figure 14:
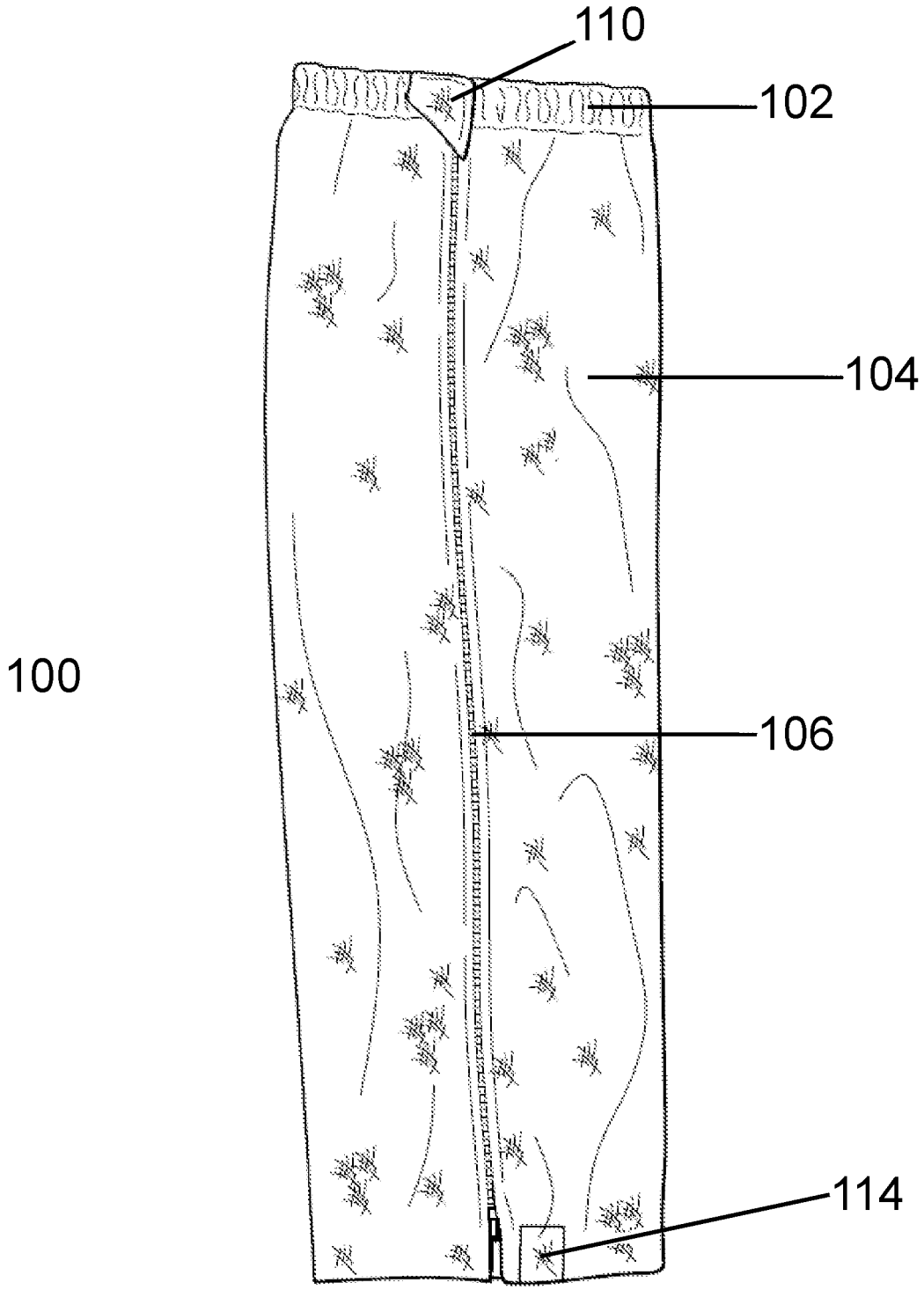
FIG. 14 is an image of pants (100) of FIG. 4 lacking a cuff.

Pants (100) can include additional elements. With reference to FIGS. 9-13, pants (100) may include one or more pockets (118) on the front and/or back of pants (100). In one example, pockets (118) are visible when pants (100) are viewed from the front, and have a slanted opening oriented between outseam (106) and waistband (102). In other embodiments, pockets (118) may have a vertical opening that runs along outseam (106), and such pockets would not be visible when pants (100) are viewed from the front. Pants (100) may also contain reflective piping positioned along outseam (106) on one or both sides of zipper (112) to improve the visibility of a wearer at night.

Pants (100) provide comfort for a wearer with highly sensitive skin or sensory issues relative to traditional pants. Waistband (102) contains elastic for comfort and for ease of sizing pants (100). Pants (100) are made of soft fabric, such as moisture wicking polyester, cotton, rayon, or denim. To prevent or reduce skin irritation or possible abrasion, zipper (112) is fully covered on the interior of pant leg (104) by flange (116) and at the exterior of waistband (102) by tab (110). Flange (116) and tab (110) may be made of thicker, softer, or more padded material than the remainder of pants (100) to further reduce the risk of skin irritation by zipper (112). If pants (100) contain logo (114), it can be positioned on cuff (108) or elsewhere on pants (100) to reduce the risk of skin irritation from an additional piece of fabric or embroidery. Alternatively, logo (114) can be screen printed onto the exterior of cuff (108) for minimal irritation. A wearer with sensory issues or highly sensitive skin, but that does not have reduced mobility, can pull pants (100) up through the legs while zipper (112) is engaged, similar to putting on traditional pants, or they can choose to put on pants (100) while zipper (112) is disengaged and pant leg (104) and waistband (102) are completely open, as described above.

Pants (100) can also be worn by individuals without any related medical needs (e.g., adults or children without sensory processing issues, reduced mobility, or medical devices on the lower extremities). Pants (100) can be worn as athletic pants by athletes, e.g., during training, or for comfort before or after exercise. Pants (100) can also be worn as lounge pants. In some embodiments, pants (100) are made using patterned fabric or fabric containing an artistic design or logo (e.g., logo of a school, organization, or sports team).

Other Embodiments

While the invention has been described in connection with specific embodiments thereof, it will be understood that it is capable of further modifications and this application is intended to cover any variations, uses, or adaptations of the invention following, in general, the principles of the invention and including such departures from the invention that come within known or customary practice within the art to which the invention pertains and may be applied to the essential features hereinbefore set forth, and follows in the scope of the claims.

Other embodiments are within the claims.

The invention claimed is:

1. An article of clothing for a human configured as pants and comprising a waistband and two pant legs connected to the waistband, wherein each of the pant legs comprises:

a) a zipper that extends from a top of the waistband and along an outseam to a bottom of the pant legs, wherein each said zipper comprises a retainer box and a zipper slider, wherein the zipper slider is configured to be engaged at the waistband, wherein each said zipper of the pant legs is configured for closure by pulling the zipper slider down from the top of the waistband along the outseam toward the bottom of the pant legs, and wherein the waistband and the pant legs comprising each said zipper can be opened completely along the outseam when each said zipper is disengaged;

b) a flange of fabric that is disposed along the outseam on an interior side of each said zipper of the pant legs, wherein each said flange of fabric has a width across the outseam that is greater than a width of the zipper of each of the pant legs when the zipper is engaged, wherein each said flange of fabric comprises a first edge and a second edge separated by the width of the flange of fabric, wherein the first edge of the flange of fabric of each of the pant legs is attached on an interior of the pant legs next to a track of the zipper and the second edge is not attached, wherein the flange of fabric of each of the pant legs is configured to cover the zipper track, wherein the flange of fabric extends from the top of the waistband to the bottom of the pant legs, and wherein the flange of fabric comprises multiple layers of fabric; and c) a fabric tab attached at the waistband next to the zipper of each of the pant legs, wherein the fabric tab comprises multiple layers of fabric and a first end and a second end, wherein the first end of the fabric tab is attached to the top of the waistband and along an exterior thereof and the second end of the fabric tab is not attached to the waistband or the pant leg, wherein a side of the fabric tab at the second end does not comprise a fastener, wherein the first end of the fabric tab is longer than the second end of the fabric tab, and wherein the fabric tab of each of the pant legs folds completely over the top of the waistband to cover the retainer box and an exterior of the zipper in the waistband and cooperates with the flange of fabric to fully enclose the zipper on the interior of the pant leg and at the top and exterior of the waistband in a first position and unfolds away from the zipper along the waistband to uncover the zipper in a second position.

* * * * *